US005775655A

United States Patent [19]

Schmeets

[11] Patent Number: 5,775,655

[45] Date of Patent: Jul. 7, 1998

[54] COLLLAPSIBLE AND ADJUSTABLE SUPPORT MEANS FOR ATTACHMENT TO A BUILDING STRUCTURE

[76] Inventor: Harold H. Schmeets, Rural Rte. 2, Box 82, Harvey, N. Dak. 58341

[21] Appl. No.: 717,864

[22] Filed: Sep. 23, 1996

[51] Int. Cl.[6] ..... E04G 3/08

[52] U.S. Cl. ..... 248/240; 248/242; 108/115; 108/42

[58] Field of Search ..... 108/42, 47, 115; 248/240, 240.4, 242, 240.1

[56] References Cited

U.S. PATENT DOCUMENTS

| | | | |
|---|---|---|---|
| 3,485,382 | 12/1969 | Larson | 248/242 X |
| 4,420,137 | 12/1983 | Barrash . | |
| 4,840,340 | 6/1989 | Vasteras et al. . | |
| 4,998,484 | 3/1991 | Groetzinger | 108/115 X |
| 5,381,738 | 1/1995 | Meyer | 108/42 |
| 5,404,962 | 4/1995 | Carter . | |

FOREIGN PATENT DOCUMENTS

| | | | |
|---|---|---|---|
| 169694 | 6/1954 | Sweden | 108/47 |
| 339349 | 9/1959 | Switzerland | 108/47 |

*Primary Examiner*—Peter M. Cuomo
*Assistant Examiner*—Stephen Vu
*Attorney, Agent, or Firm*—David A. Lingbeck

[57] ABSTRACT

A collapsible and adjustable support for attachment to a building structure includes at least one bracket member which has a first extended member having a first channel and being attachable to the building structure and further has a second extended member having a second channel and having a proximate end which is pivotally attached to the top end of the first extended member, the second extended member further having a distal end which provides the second extended member with adjustable load bearing positions including a generally horizontal position and positions relative thereto, the second extended member capable of being received in the first channel. The collapsible and adjustable support also includes a brace member which raises and lowers the distal end of the second extended member and supports the second extended member and can be collapsed and lockingly stored in the second channel. The collapsible and adjustable support can support shelves and table tops and hanging objects.

3 Claims, 3 Drawing Sheets

COLLLAPSIBLE AND ADJUSTABLE SUPPORT MEANS FOR ATTACHMENT TO A BUILDING STRUCTURE

BACKGROUND

This invention relates to a collapsible and adjustable support means for attachment to a building attachment for supporting shelves, table tops, and objects which can be hung.

Wall shelves/table tops comprising elongated planar members for supporting objects are mounted to the walls of building structures with brackets and bracket supports which are fastened or bolted to the wall and with the brackets most often secured to the bracket supports with some brackets capable of being easily detached from the bracket supports and with the shelves/tables either being fastened to the brackets or being rested upon the brackets in a generally horizontal position.

One known prior art is an ADJUSTABLE FOLDING, SPRINGBACK SHELF BRACKET, U.S. Pat. No. 4,420,137, invented by Marshall J. Barrash and issued on Dec. 13, 1983, which comprises a back member; a shelf support member movable relative to the back member; a hinge means for permitting movement of the shelf support member relative to the back member; a mounting flange on the back member; channel means in the back member; and spring means associated with the channel means for biasing the back member.

Another known prior art is a TELESCOPIC BRACE ASSEMBLY, U.S. Pat. No. 4,840,340, invented by Hans Gustafsson and issued on Jun. 20, 1989, which comprises two tubes, one of which is telescopic as to the other; a spring for biasing the two tubes together; and locking means for releasably locking the telescopic tubes relative to one another in an active supporting position of the brace assembly.

Another known prior art is a COLLAPSIBLE SUPPORT, U.S. Pat. No. 5,404,962, invented by John T. Carter and issued on Apr. 11, 1995, which comprises a generally planar load-bearing base member; a leg carrier; a pair of legs being received within the leg carrier; pivot means for pivotally securing the leg carrier to the base member; and a lock means for releasable latching the leg carrier in a load bearing position.

None of the prior art describes the present invention which is easier and more simple to mount to a building structure such as a wall and to use than any of the prior art.

SUMMARY OF THE INVENTION

The present invention relates to a collapsible and adjustable support means for attachment to a building structure which comprises at least one bracket member which includes a first extended member and a second extended member which has an end pivotally attached to an end of the first extended member, and also includes an elongated brace member which has a first end pivotally attached to a medial portion of the second extended member with a second end being detachably and adjustably attached to and along a medial portion of the first extended member which is fastenable vertically to a building structure. In a load bearing position, the second extended member extends outwardly from the building structure and supports the shelf/table top. The distal end of the second extended member can be adjusted upward relative to the horizontal. The support means can be easily and conveniently folded up against the building structure out of the way when not in use.

One objective of the present invention is to provide a collapsible and adjustable support means for attachment to a building structure which allows the user to quickly and easily set up a shelf or table top in a load bearing position.

Another objective of the present invention is to provide a collapsible and adjustable support means for attachment to a building structure which allows the user to easily adjust the slope of the shelf/table top relative to the horizontal depending upon the need for the shelf/table top.

Also, another objective of the present invention is to provide a collapsible and adjustable support means for attachment to a building structure which can be easily and quickly folded up against the building structure with the shelf/table top either being dropped down against the building structure or being removed from the support.

Further objectives and advantages of the present invention will become apparent as the description proceeds and when taken in conjunction with the accompanying drawings wherein:

DETAILED DESCRIPTION OF THE INVENTION

Figure 1:
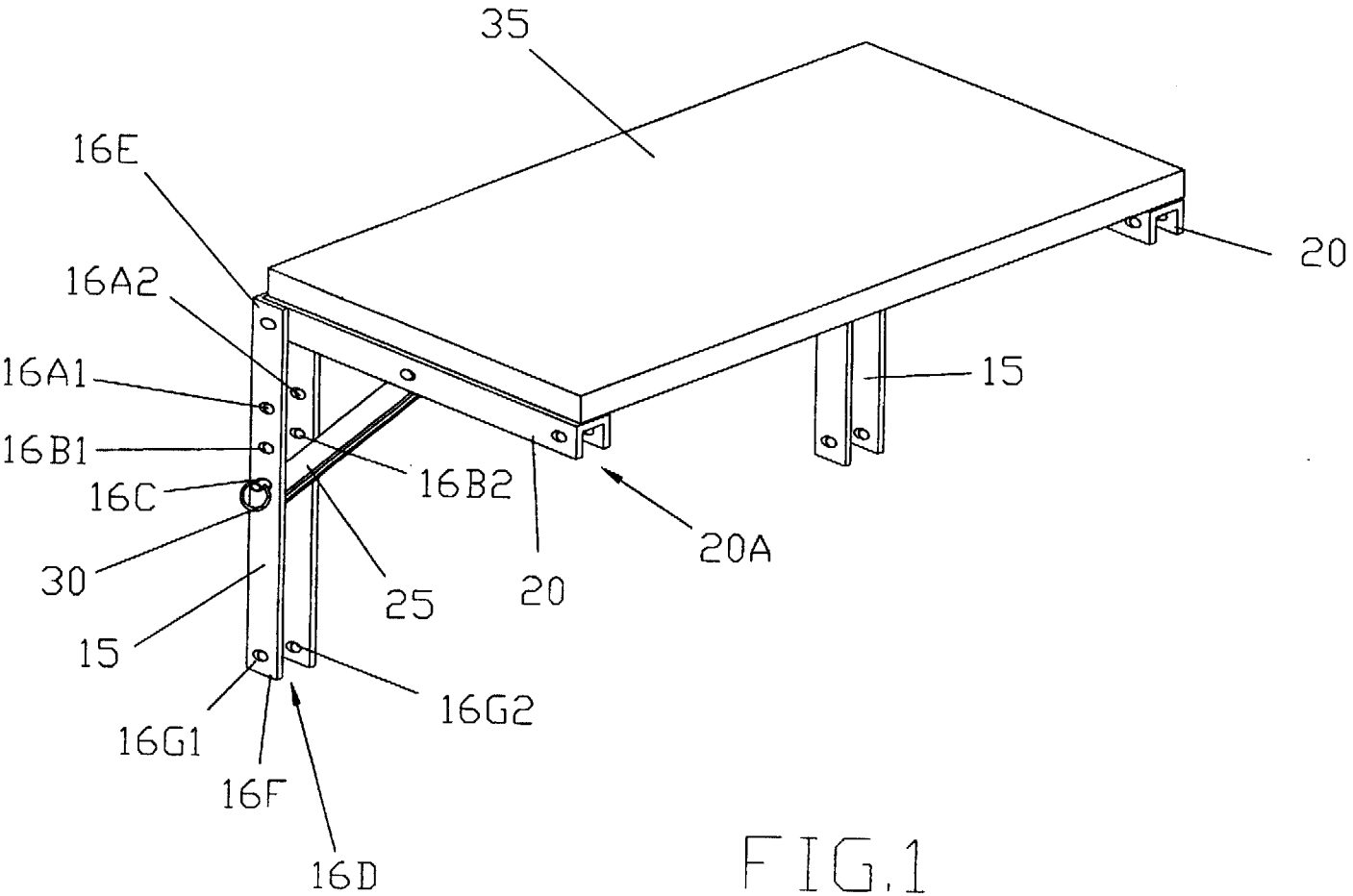
FIG. 1 is a perspective view of two collapsible and adjustab support means mounted to a wall in a load bearing position and supporting a shelf/table top.
Figure 2:
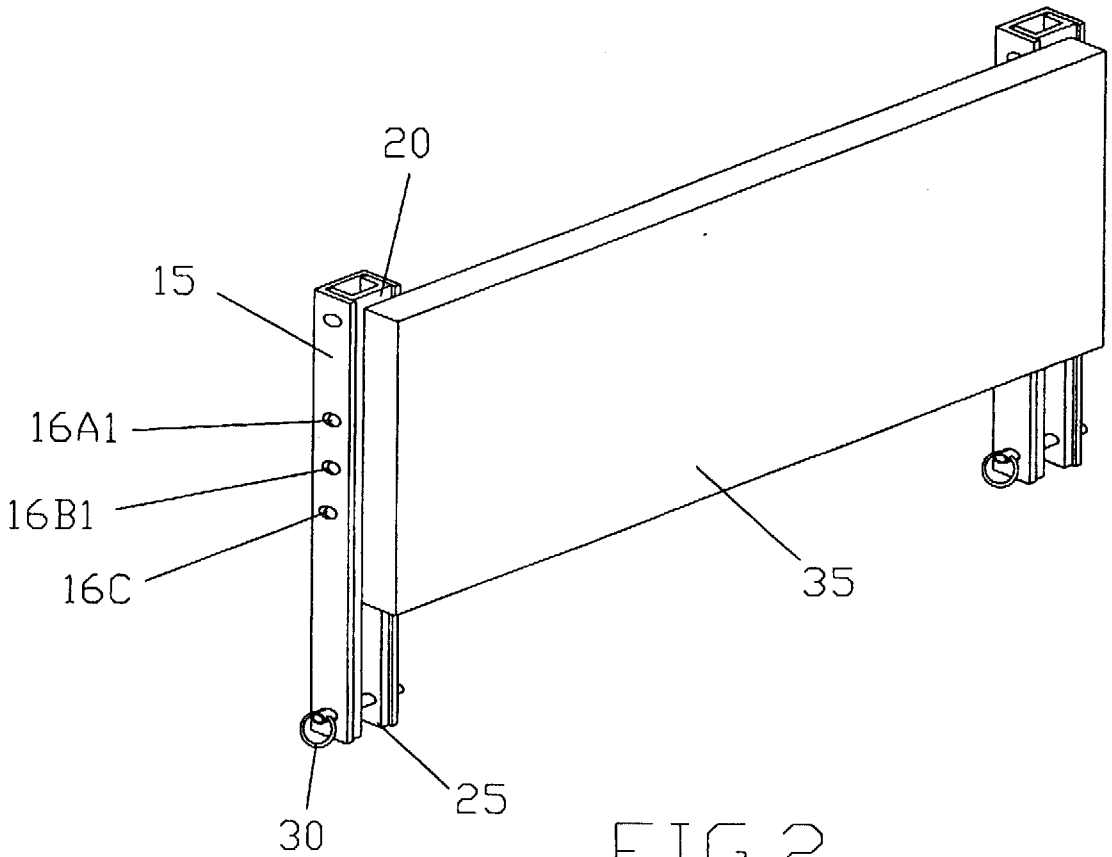
FIG. 2 is a perspective view of two collapsible and adjustable support means mounted to a wall in a collapsed and folded position and supporting a shelf/table top.
Figure 3:
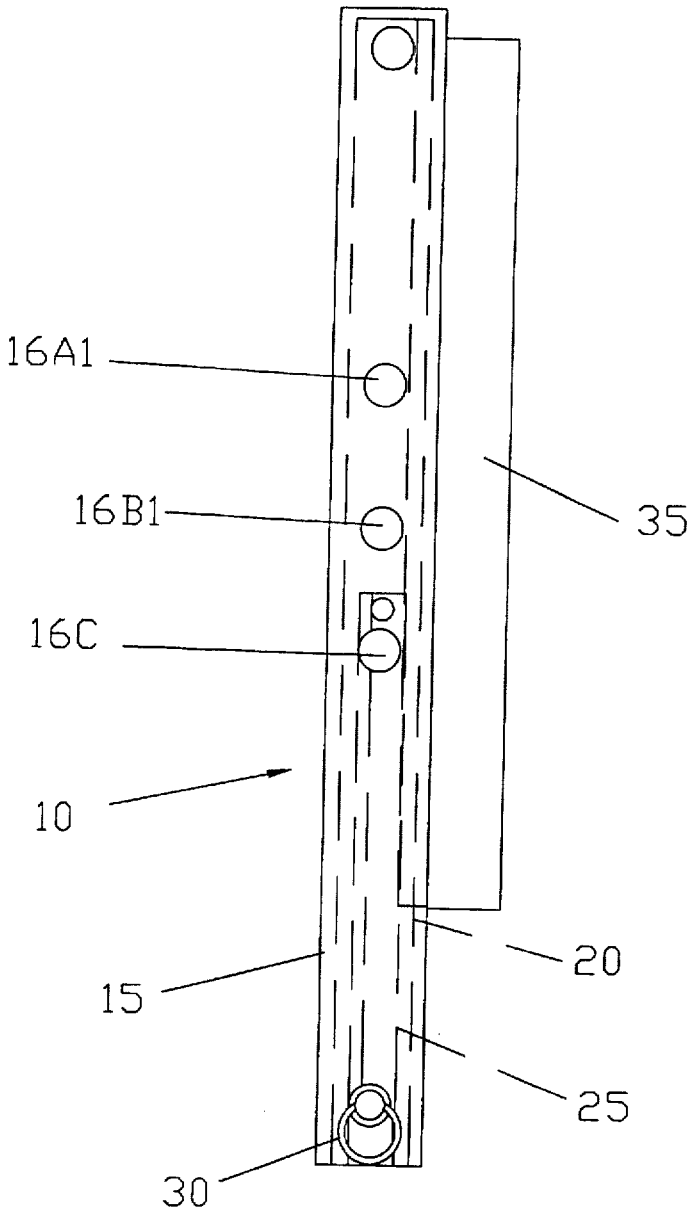
FIG. 3 a side elevational view of the collapsible and adjustable support means being collapsed and stored with the brace being received in the second extended member which is being received in the first extended member.

Referring to the drawings in FIGS. 1–3, in particular, the collapsible and adjustable support means for attachment to a building structure such as a wall structure comprises at least one bracket member which includes a first extended member 15 having a back wall and two opposed side walls and an open front with the side walls defining a first channel 16D therebetween; a second extended member 20 having a top wall and two opposed side walls and an open bottom and having a proximate end pivotally attached to a top end 16E of the first extended member 15 and being adapted to be received through the open front and entirely in the first channel 16D of the first extended member 15 with the side walls of the second extended member 20 defining a second channel 20A therebetween; and a brace member 25 having a first end pivotally attached to a medial portion of the second extended member 20 and having a second end detachably and adjustably attached with a fastener 30 such as a pin to and along a medial portion of the first extended member 15 of which has three holes 16A1-2,16B1-2,16C spaced along and through a medial portion of each of the side walls thereof for receiving the fastener 30, the brace member 25 further having a hole at the second end thereof, through which the fastener 30 can be inserted to secure the brace member 25 to the first extended member 15, the brace member 25 further being adapted to be received through the open bottom and entirely in the second channel 20A of the second extended member 20.

In operation, the collapsible and adjustable support means is mounted to a wall structure with the back end of the first extended member 15 being placed in contact and flush with the wall structure and with fastening members such as screws being inserted through the back wall of the first extended member 15 into the wall structure to secure the support means to the wall structure, the first extended member 15 being preferably disposed vertically upon the wall structure with the second extended member 20 being pivotally extended outwardly of the wall structure in a load bearing position and with the brace member 25 being secured with the fastener 30 to the first extended member 15. A planar member 35 such as a shelf or table top is mounted upon the top wall of the second extended member 20 and can either be fastened to the top wall with screws inserted through the top wall into the planar member 35 or be simply rested upon the top wall. The distal end of the second extended member can be adjusted upward relative to the horizontal by moving the second end of the brace member 25 which is detachably attached to the first extended member 15 along the medial portion of the first extended member 15 and upward to any of the holes 16A1-2, 16B1-2,16C1 along the side walls of the first extended member 15 and by inserting the fastener 30 through the selected holes in the side walls of the first extended member 15 and through the holes at the second end of the brace member 25.

If the user doesn't have any use for the collapsible and adjustable support means, the user can collapse and store the support means by removing the fastener 30 from the holes in the brace member 25 and the first extended member 15 and then by pivoting the brace member 25 and the second extended member 25 so that much of the brace member 15 is received in the second channel 20A of the first extended member 15 and the entire second extended member 20 is received in the first channel 16D of the first extended member 15, and if the shelf/table top 35 is securely mounted to the top wall of the second extended member 20, as illustrated in FIG. 3, the shelf/table top 30 will drop down against the wall structure and be substantially parallel to the wall structure. Further, the support means can be locked in a collapsed and stored position for safety by inserting the fastener 30 through bottom end holes 16G1-2 at the bottom end 16F of the first extended member 15 and at the second end of the brace member 25. If the user wants to use the shelf/table top 35, the user can raise the distal edge of the shelf/table top 35 relative to the wall structure and pivot the second extended member 20 relative to the first extended member 15 and pivot the brace member 25 about the second extended member 20 and attach the brace member 25 to the first extended member 15 by inserting the fastener 30 through the holes in the brace member 25 and the first extended member 15. If needed, more than one bracket member can be mounted to the building structure and be positioned in spaced relationship and in alignment to the other one or more bracket members to better support a shelf or table top 35.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A collapsible and adjustable support means for attachment to a building structure comprising:

at least one bracket member having a first extended member, a second extended member having a proximate end which is pivotally attached to said first extended member, a fastener member, and a brace member having a first end fastened to said second extended member and having a second end detachably and adjustably fastened with said fastener member to and along said first extended member for attachment to a building structure with said second extended member capable of either being collapsed upon said first extended member or extended in a load bearing position, said first extended member having a back wall and two side walls, said two side walls defining a first channel therebetween, which is adapted to receive said second extended member when said support means is placed in said collapsed and stored position, further said first extended member having a plurality of holes spaced along and extended through said side walls thereof and adapted to receive said fastener member for fastening said brace member to and along said first extended member.

2. A collapsible and adjustable support means for attachment to a building structure as described in claim 1, wherein said second extended member has two side walls which define a second channel therebetween, said second channel being adapted to receive a portion of said brace member when said support means is placed in said collapsed and stored position, a distal end of said second extended member having changeable load bearing positions relative to the horizontal, said changeable load bearing positions being dependent upon positioning of said second end of said brace member relative to said first extended member.

3. A collapsible and adjustable support means for attachment to a building structure as described in claim 1, wherein said first extended member further has two bottom end holes each of which extends through a respective said side wall at a bottom end of said first extended member, said bottom end holes being adapted to receive said fastener member to lockingly secure said second end of said brace member to said first extended member for safely placing said support means in said collapsed and stored position.

* * * * *